United States Patent [19]

Furutu

[11] 4,131,504

[45] Dec. 26, 1978

[54] HAND LABELLER

[75] Inventor: Akira Furutu, Tokyo, Japan

[73] Assignee: Japan Bano'K Co., Ltd., Tokyo, Japan

[21] Appl. No.: 800,030

[22] Filed: May 24, 1977

[30] Foreign Application Priority Data

Dec. 30, 1976 [JP] Japan ..... 52-176172[U]
Dec. 30, 1976 [JP] Japan ..... 52-176173[U]
Dec. 30, 1976 [JP] Japan ..... 52-176175[U]

[51] Int. Cl.[2] ..... B41F 1/28; B41F 21/00

[52] U.S. Cl. ..... 156/384; 156/541; 156/584; 156/DIG. 37; 156/DIG. 49

[58] Field of Search ..... 156/384, 584, 541, 542, 156/DIG. 48, DIG. 49, DIG. 37

[56] References Cited

U.S. PATENT DOCUMENTS

| | | | |
|---|---|---|---|
| 3,968,745 | 7/1976 | Hamisch | 156/384 |
| 4,008,119 | 2/1977 | Hermann | 156/584 |
| 4,026,758 | 5/1977 | Sato | 156/584 |

FOREIGN PATENT DOCUMENTS

| | | | |
|---|---|---|---|
| 2428998 | 1/1976 | Fed. Rep. of Germany | 156/384 |
| 2437999 | 2/1976 | Fed. Rep. of Germany | 156/384 |
| 2460444 | 6/1976 | Fed. Rep. of Germany | 156/384 |
| 2502108 | 7/1976 | Fed. Rep. of Germany | 156/384 |

*Primary Examiner*—Caleb Weston
*Attorney, Agent, or Firm*—Armstrong, Nikaido, Marmelstein & Kubovcik

[57] ABSTRACT

A hand labeller comprising a label sheet roll for supplying a label sheet consisting of a carrier paper and label blanks laminated on the carrier paper, typing means for pressing the labels sheet onto an anvil plate thereby to effect a typing on each one of the label one by one, and labelling means for adhering the label carrying the typed letter onto the object to be labelled. The labelling means have a cut out or partially removed back adapted to be reciprocatingly moved within an angular range which does not interrupt the passing of an ink roller. The typing means include a roller for supporting a type wheel and having a plurality of projections projecting toward a supporting shaft, and an engaging piece disposed in a bore of said shaft and resiliently biased to project out of the surface of the shaft. The arrangement is such that the projections of the roller are brought into engagement with the engaging piece, in accordance with the rotation of the shaft. The label sheet roll is supported by a supporting member having a slit extending from one toward the other axial ends and a retaining portion provided in the vicinity of the starting end of the slit. The supporting member is adapted to be received by a bore formed in the labeller body, and is prevented from being dropped off from the bore by a projection formed in the bore. The hand labeller further has a guide plate for guiding the label sheet to the anvil plate, having at its intermediate portion a winding section. A feed roller is provided confronting the winding section to press the label sheet onto the winding section.

16 Claims, 26 Drawing Figures

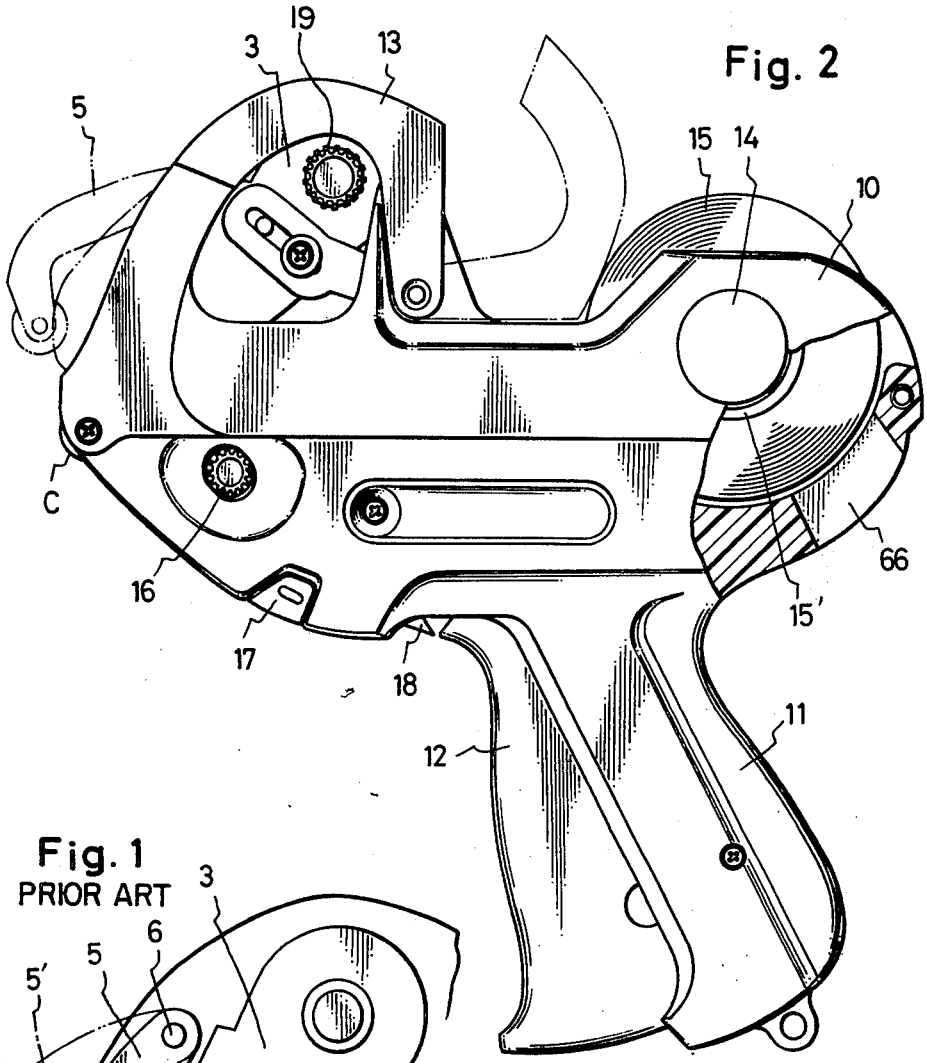
Fig. 2
Fig. 1
PRIOR ART
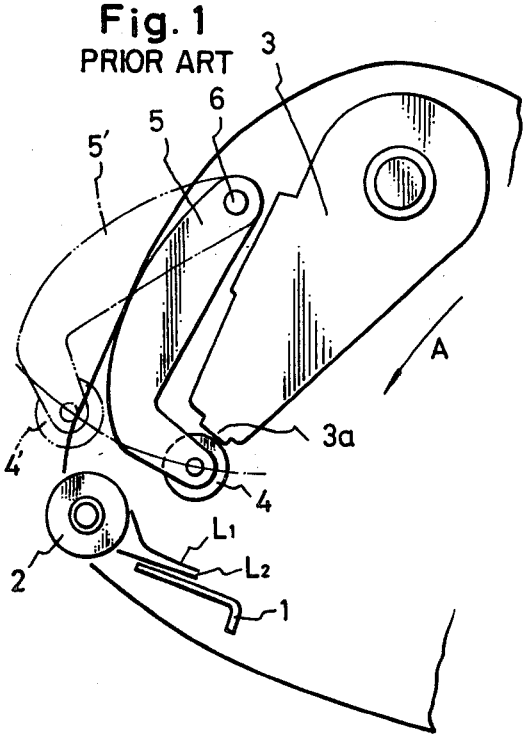

HAND LABELLER

BACKGROUND OF THE INVENTION

The present invention relates to an improvement in hand labellers for adhering labels carrying informations such as price of a good typed thereon, onto objective goods and the like.

In conventional hand labellers, a label blank applied with an adhesive is adhered to a substrate or carrier paper in the form of a rolled sheet adapted to be fed to the labeller body. A typing is effected onto the labels, one by one, by an action of a lever. The labels carrying the typed informations are then successively peeled off from the substrate plate and pressed onto the objective goods to be labelled, by means of a rubber roller provided at the end of the labeller, to be adhered thereto.

In these conventional labellers, the delivery of the labels is apt to become unstable, because the rubber roller 2 is provided in front of the anvil plate 1 which constitutes a support during the typing, as shown in FIG. 1. Namely, the end of the label is likely to be turned above the roller 2, as denoted by L1, or to abut the roller 2 as denoted by L2, so as to disturb the continuous feed of the labels. The anvil plate 1 is adapted to cooperate with a typing device 3 in effecting a typing onto the label carried by a laminated sheet consisting of a substrate plate and labels adhered thereto. The typing is performed by pressing the typing device onto the anvil plate 1, with the laminated sheet interposed therebetween. When the typing device is at its elevated position as shown in FIG. 3, a typing body 3*a* is brought into contact with an ink roller 4 which is supported by a rocking lever 5 on a shaft 6. When the typing device is lowered as denoted by an arrow A after the application of the ink to the typing body 3*a*, the rocking lever 5 and the ink roller 4 are moved to positions denoted by numerals 5' and 4', respectively.

For ensuring that the roller 2 is not contacted by the ink roller 4, the roller 2 should have a small diameter. However, too small diameter of the roller 2 may cause a deterioration of the label adhesion. On the other hand, too large diameter of the roller 2 may cause the ink roller 4 positioned away from the anvil plate 1. The typing device provided above the ink roller 4 is positioned further away from the anvil plate 1. The larger distance between the typing device and the anvil plate requires a larger stroke of the typing device 3 and, accordingly, a larger stroke of the lever, which results in a difficulty in rapidly adhering the labels.

To the contrary, when the diameter of the roller 2 is made small, for obtaining the smaller stroke of the typing device 3, the adhesion of the label is inevitably deteriorated.

The conventional hand labeller further has an unsolved problem concerning the typing device. More specifically, as is well known, symbols or numerals are used to represent the price of goods and other informations required for the management of goods, e.g. sales accomplishments and storage.

To this end, the typing device in hand labeller must be constructed to provide an easy altering or changing of the types of numerals and/or symbols.

Typical typing device conventionally used has a plurality of type wheels each of which consisting of an endless rubber belt carrying a series of numerals and symbols on its peripheral surface. These type wheels are supported on a supporting body for circumferential movement, i.e. rotation, thereon. For rotating these type wheels, the rollers supporting the wheels are provided with respective driving wheels having a plurality of teeth-like projections, so that the wheels may be rotated independently. However, in such an arrangement, the type wheel is likely to be rotated erroneously, when the adjacent one is rotated, to disturb the correct arraying of the numerals and symbols. This problem attributable to the driving of the type wheels is more serious in modern typing device in which the width of the type wheel is small in order that the typing device can include more types of numerals and symbols for increased information.

In order to overcome this problem, it has been proposed to provide an operation wheel in parallel with the wheel-supporting shafts and in engagement with the driving wheels, so as to allow the independent driving of the type wheels. However, such a device cannot be incorporated in a compact apparatus, because of its large size.

Another proposal is to drive the type wheels by means of a shaft passing through the center of the wheel-supporting roller. However, this proposal is found also unacceptable in that the length of the shaft becomes as large as two times that of the breadth of the typing device, to project largely laterally from the typing device, which causes inconveniences in handling and designing of the device.

The conventional hand labellers present still further problem, as to the attaching and detaching of the label sheet roll to and from the labeller body.

Conventionally, the label sheet roll is attached to the labeller body in such a manner that both ends of a core member passing through the central bore of the roll are received by respective recesses formed in the labeller body. This way of attaching is however found inconvenient in that the attaching and detaching becomes difficult as the sheet is consumed away to reduce the diameter of the roll. This is true especially when all of the sheet has been consumed away to leave only the core in the recesses of the body. The core is then difficult to access by fingers. In addition, the core which is easily separable from the labeller body is likely to be missed in the labeller body.

Another way for attaching the label sheet roll is to provide the labeller body with two flexible supports between which the label sheet roll is clamped. However, this arrangement is unacceptably large in size and has an unattractive appearance.

A still further drawback inherent in the conventional hand labeller resides in a difficulty in attaching the label sheet along the predetermined path. A considerable number of labels are missed in this work. More specifically, in loading the labeller with the roll of label sheet, at first the roll is mounted on an upper rear portion of the hand labeller, with the lower cover of the labeller body removed or opened. Then, the leading end of the label sheet is passed through a gap between the sprocket and the anvil plate, and is pulled out of the labeller body through the lower portion of the latter. Then, the leading end of the label sheet is fed onto the anvil plate and is made to go round the anvil plate to reach the back side thereof. The leading end of the sheet is then extended to reach the sprocket. This work for loading the labeller with the sheet is extremely troublesome and time-consuming for those who are not trained. In addition, the label blanks having been peeled off from the substrate plate are likely to accidentally stick to the guide or rollers.

The present invention is to provide solutions to the above stated problems of the prior art.

It is therefore an object of the invention to provide a light-weighted hand labeller which can be handled easily by a single hand for a smooth adhering of labels on which numerals and symbols representing the information such as price and classifications are typed.

It is another object of the invention to provide an improved hand labeller in which the conventional rubber roller is substituted by a labelling cam provided with a pressing surface having a large radius of curvature, which ensures the correct delivery of the labels and pressing of the object at a larger area, as well as a reduced stroke of the typing device.

It is still another object of the invention to provide a hand labeller equipped with a typing device having a compact and simplified structure and designed for an easier change of numerals and letters.

It is a further object of the invention to provide a hand labeller to which the label sheet roll having label blanks adhered to a carrier or substrate paper can easily be attached.

It is a still further object of the invention to provide a hand labeller in which the buckling or bending of the labels to be fed to the anvil plate is corrected to facilitate the guiding of the label to the gap between the anvil plate and labelling means such as a labelling roller or a labelling cam.

SUMMARY OF THE INVENTION

According to the invention, there is provided a hand labeller comprising a label sheet roll for feeding a label sheet having a label blank laminated on a carrier paper, a typing device for pressing the label sheet fed by the roll onto an anvil plate thereby to effect a typing on label blanks one by one, and labelling means for adhering the labels carrying the typed informations on to an object to be labelled, wherein the labelling means have a cut out or partially removed back which is allowed to be reciprocatorily rotated over an angular range which does not interrupt the passing of an ink roller. The typing device has type-wheel supporting rollers having a plurality of projections extending toward its supporting roller, and an engaging piece disposed in a bore formed in the shaft and is resiliently biased to project out of the surface of the shaft, such that the projections of the roller and the engaging piece are brought into mutual engagement in accordance with the rotation of the shaft. A wall connecting one faces of the projections is provided on the roller, so that the engaging piece is depressed by the wall of the roller when the supporting shaft is laterally moved. Thus the desired roller can selectively be rotated by rotating the supporting shaft subsequent to a lateral displacement thereof. The label sheet roll is supported by a supporting member which is provided with slits extending from one toward the other axial ends thereof and a retaining portion provided in the vicinity of the starting end of the slit.

The supporting member is received by a bore formed in the labeller body and is prevented from being dropped off by a projection formed in the bore.

These and other objects, as well as advantageous features of the invention will become clear from the following description of preferred embodiments taken in conjunction with the attached drawings in which:

BRIEF DESCRIPTION OF THE DRAWINGS

FIG. 1 is an illustration for explaining the operation of a typing section of a hand labeller;

FIG. 2 is a fragmentary side elevational view of a hand labeller embodying the present invention;

FIG. 10A is a front elevational sectional view of another example of the labelling cam, while

DESCRIPTION OF THE PREFERRED EMBODIMENTS

Figure 3:
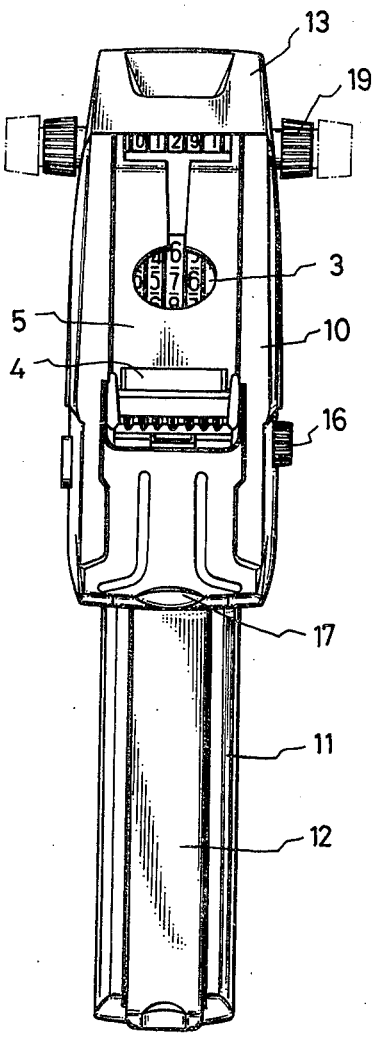
FIGS. 3 and 4 are front and back elevational views, respectively, of the hand labeller of FIG. 2.
Figure 4:
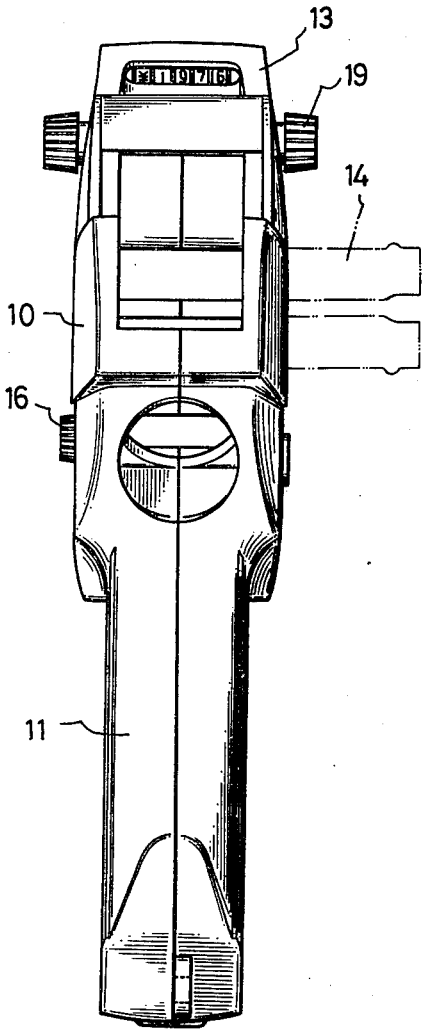

Referring at first to FIG. 2 showing a hand labeller embodying the present invention, a labeller body generally denoted by 10 has a form of a pistol for easier handling, having a grip portion 11 in which a lever 12 is provided for an opening and closing motion. A rocking lever 5 which plays also the role of a cover for closing the front opening of the body 10 is located forwardly of the body 10. A cover 13 is provided at the top of the body 10.

A supporting member 14 for a label sheet roll 15 (This label sheet roll consists of a carrier paper carrying a number of label blanks laminated thereto) is adapted to be partially extracted from the lateral side of the labeller body 10, for supporting the label sheet roll 15. A typing device 3 is provided under the cover 13, for free up and downward movement. Numerals 16, 17, 18 and 19 denote, respectively, a shaft for a feed roller 23, a back or lower cover a substrate paper cutter and a type selecting lever.

Figure 5:
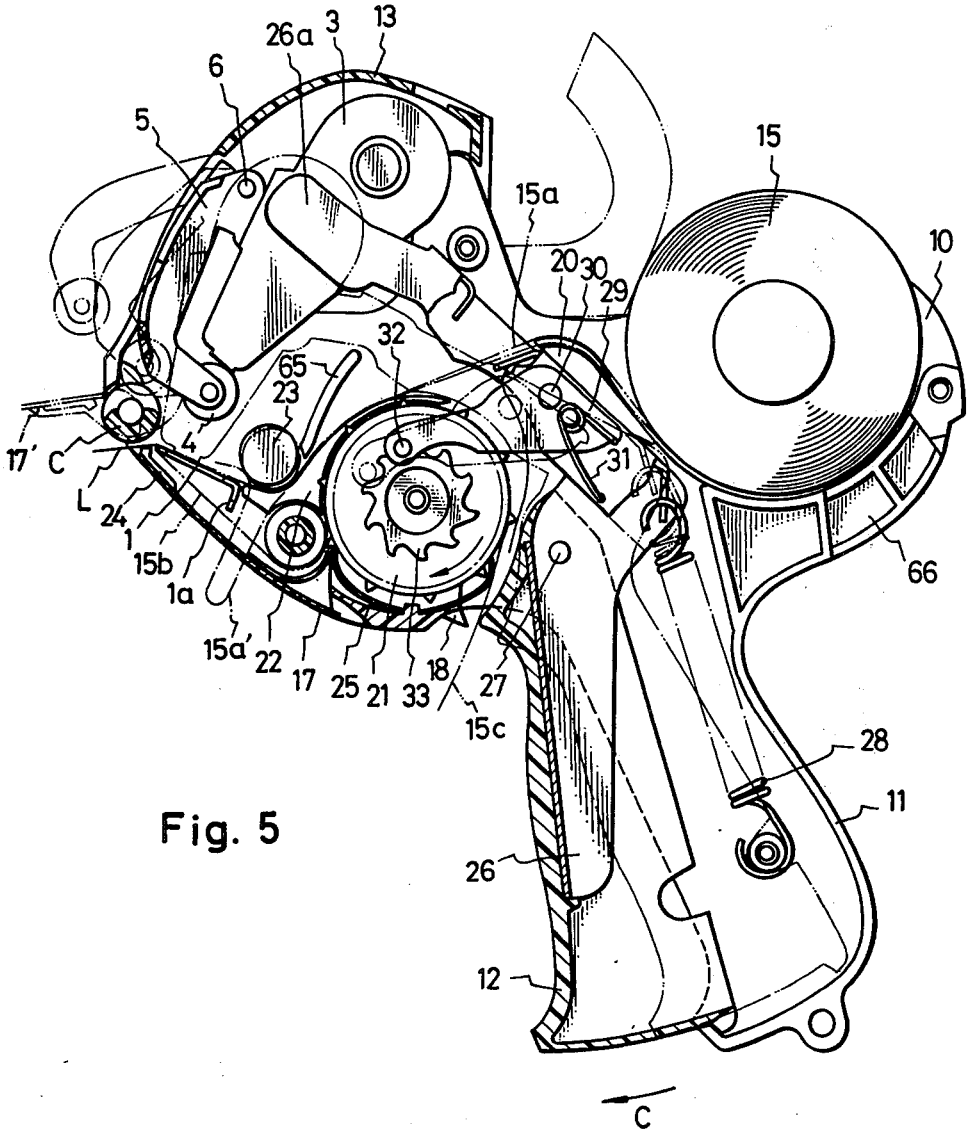
FIG. 5 is a sectional side elevational view of the hand labeller of the invention, showing the internal structure of the later.

The manner of operation of the hand labeller will be described hereinafter with reference to FIG. 5 showing the internal structure of the labeller.

The laminated sheet adhered to the carrier paper released from a label reel 15 is sent to a position 15*a*, by a guide 20, and is then made to pass the surface of a guide plate 22 provided to cover the ⅓ of the upper face of a sprocket 21. The sheet is then bent at the position of the aforementioned feed roller 23, and is made to pass over the surface of the anvil plate 1. At the end of the anvil plate 1, the sheet is acutely bent to follow a path 15*b*. In this condition, the label L is peeled off from the substrate plate and is temporarily adhered to a label receiving claw 24. The carrier paper having released the label has perforations along its center line, for engagement with a sprocket 21 so as to be intermittently extracted through a path 15*c*.

An auxiliary cutter 1*a* may be provided at the end of the anvil plate 1, having a downwardly directed cutting edge, so that the carrier paper after the removal of the label may be pressed by finger nail onto the edge for severing the paper. This considerably facilitates the ejection of the used carrier paper from the labeller. At the same time, the replacement of the roll for a new object is much simplified and facilitated, comparing the severing of the carrier paper at a position downstream of the anvil plate 1.

A spring-like stopper 25 is provided on the surface of the sprocket 21. This stopper 25 has double functions of allowing the rotation of the sprocket 21 in the direction of the arrow B and ensuring the separation of the carrier paper from the surface of the sprocket 21 along the path 15*c*.

The typing and label feeding operations are performed in the following manner.

A lever core 26 is supported at its center by a shaft 27, and is disposed within the lever 12. The core 26 is swingable, being biased clockwisely, as viewed in FIG. 5, by means of a spring 28. A feed cam 29 is supported by the lever core 26, through a shaft 30, and is applied with a counter-clockwise resilient torque 31 by action of a spring 31. The feed cam 29 carries at its end a pin 32 for engagement with a ratchet 33 provided at a side of the sprocket 21. The arrangement is such that the feed cam 29 is retracted from the position of broken line to the position of full line, as the lever 12 is rotated in the direction of the arrow C (position of broken line to position of full line, FIG. 5), so as to rotate the sprocket 21 in the direction of the arrow B, thereby to feed the sheet by a length of one label for each operation of the lever 12.

The lever core 26 is slightly bent at its intermediate portion to have a <-shaped profile and is forked at its end into two separate arms 26*a* between which are supported in the typing device 3.

Therefore, the typing device 3 performs a stroking from the position of full line to the position of broken line, as the lever 12 is rotated to the position of the broken line, so as to press the label blank on the anvil plate 1. During this movement of the typing device 3, the ink roller 4 is made to contact the type wheels to supply the later with the ink, and then moves away from the wheels to the position of the broken line.

An explanation will be made hereinafter, as to a labelling cam which constitutes an essential part of the invention.

Figure 6:
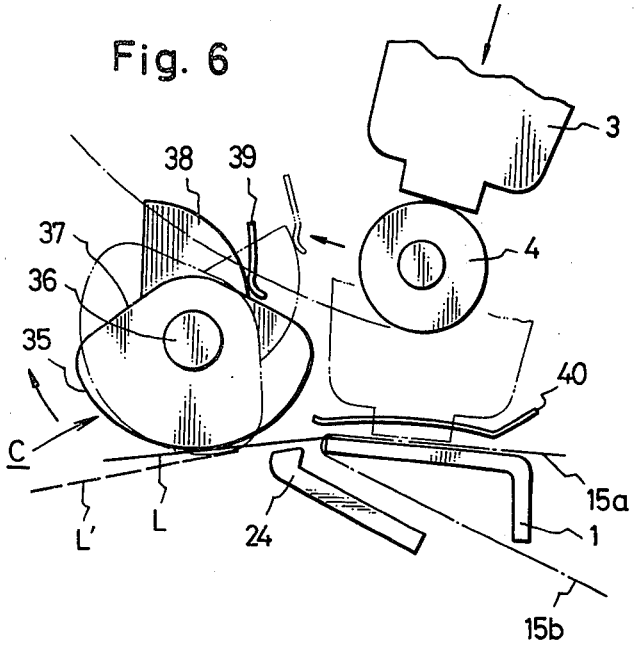
FIG. 6 is an illustration explaining the operation of the typing section of the hand labeller of the present invention.
Figure 7:
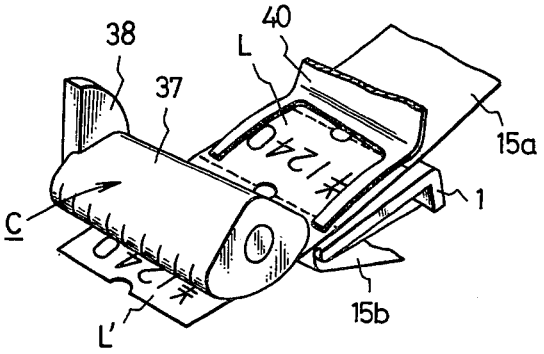
FIGS. 7 and 8 are a perspective view and a labelling cam, respectively.
Figure 8:
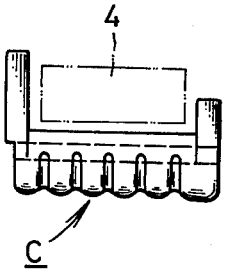

FIG. 6 is a side elevational view of a labelling cam C for pressing the label onto an object, the ink roller 4 and of the anvil plate 1, showing the mutual relationship therebetween. FIGS. 7 and 8 are perspective and front elevational views of the labelling cam C, respectively.

The labelling cam C in accordance with the invention has a sector-shaped side elevation, and has a pressing surface 35 constituted by an arc of a radius larger than an arc centered at a shaft 36. The back side 37 of the cam C is suitably cut out or removed. A cam 38 is provided to project laterally from the cam C, for engaging a spring 39 to return the cam C to the position of the full line.

As will be seen from FIG. 6, the laminated sheet consisting of a carrier paper carrying label blanks is guided at its side by a guide plate 40 and positioned on the anvil plate 1. The sheet 15*a* is pressed by the typing device 3 onto the anvil plate 1 so that the typing is effected on the label blanks. Then, the label carrying the typed informations is separated from the carrier sheet at the end of the anvil plate 1. The separated label is then slightly adhered to the label receiving nail or claw 24 so as to be held by the later.

Subsequently, the front portion of the hand labeller is directed to the object to be labelled. As the hand labeller is pulled, the labelling cam C is rotated to the position of the broken line, so that the label is adhered to the object at a position L'.

Figure 9:
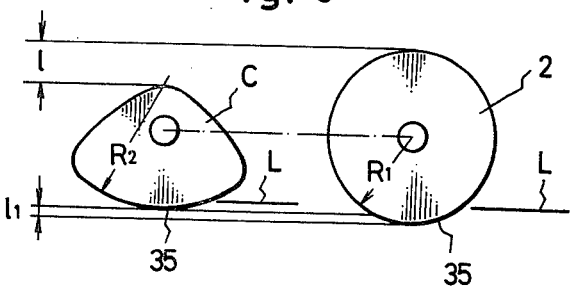
FIG. 9 shows a dimensional relationship between a conventional labelling roller and a labelling cam of the invention.

Referring to FIG. 9 showing a dimensional relationship between a conventional labelling roller 2 and the labelling cam C of the present invention, it will be seen that the cam C of the invention has a radius R2 which is much larger than that R1 of conventional roller 2. Supposing that they are arranged on a common shaft, a dimensional differential l is formed between the upper ends of the roller 2 and the cam C. This differential has a substantial significance. Namely, the smaller height of the cam C allows the ink roller 4 to get correspondingly closer to the anvil plate 1, so as to contribute to shorten the stroke of the up and downward movement of the typing device 3.

At the same time, a differential $l_1$ is left between the lower surfaces, i.e. the pressing surfaces, of the conventional roller 2 of FIGS. 1 and 9 and the labelling cam C of the invention, which is of also a substantial importance. Namely, in case of the conventional roller 2, it often takes place that the label L comes to collide with the flank of the roller 2, as shown in FIGS. 1 and 9, to hinder the smooth delivery of the label or to make the label L stick to other members. However, according to the invention, the label is delivered tangentially, without colliding the flank of the cam C.

Figure 10A:
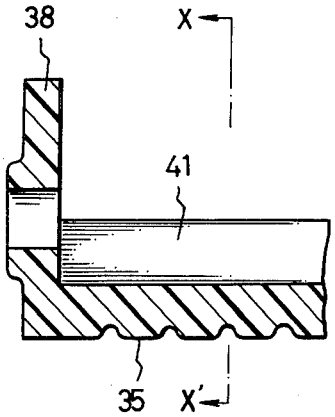
Figure 10B:
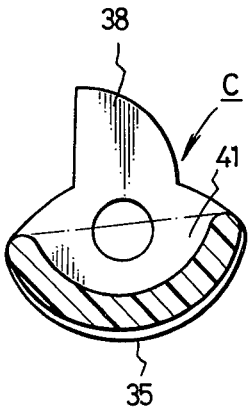
FIG. 10B is a sectional view taken along the line X–X' of FIG. 10A.

Referring to FIG. 10 showing a labelling cam having a back cut deeply to form a recess, the pressing surface portion 35 is constituted by a thin wall, while the back portion 41 is removed or cut out, so as to provide a large space for allowing the ink roller to pass therethrough. The cam C of this type may be provided with a stiffness, by enlarging the thickness to the position of chain line of FIG. 10B.

Figure 11:
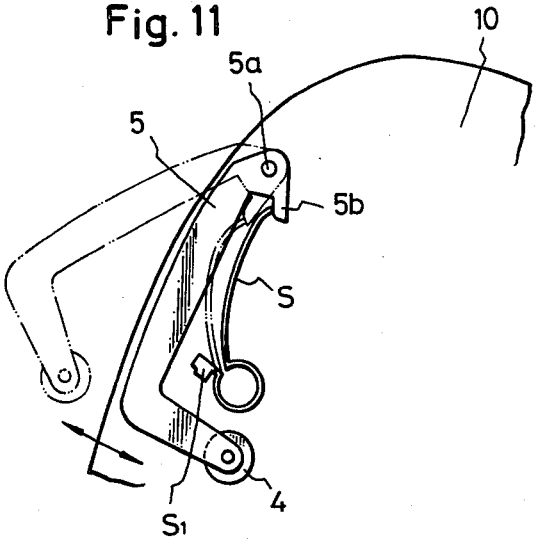
FIG. 11 is a partial illustration for explaining the detail of a rocking lever.

FIG. 11 specifically shows the detail of the rocking lever 5 which, as will be seen also from FIGS. 3 and 5, plays the additional role of a cover for closing the front opening of the labeller body 10.

The rocking lever 5 is adapted to be swung or rock, around its support 5a on the labeller body 10, from the position of full line to the position of broken line, as the ink roller 4 provided at its end is pressed by the typing device 3.

The rocking lever 5 is provided with a projection 5b which extend from its upper end obliquely downwardly and has a curved surface engaged by the upper end of a spring S. The spring S is attached to the labeller body 10 at its lower end portion S1. The arrangement is such that the spring S is moved from the position of the full line to the position of the broken line, as the rocking lever 5 rocks.

As the pressing force on the ink roller 4 by the typing device 3 is extinguished, the spring S acts to return the rocking lever 5 from the position of broken line to the position of full line, due to its resilient reactional force.

Thus, due to the provision of the labelling cam having a back cut out or removed as much as possible, swingably over a limited angular range in front of the anvil plate, the ink roller is allowed to access the anvil closely, so that the stroke of the typing device is shortened.

In addition, by adopting a large radius of curvature of the pressing surface, as shown in FIG. 9, the surface is conveniently flattened and made closer to the axis of the cam. Therefore, the label delivered from the anvil plate 1 is directed tangentially of the labelling cam C, so that the delivery of the label is much smoothened to avoid the troubles, as compared with conventional apparatus.

At the same time, the stroke of the typing device 3 is conveniently shortened to facilitate the operation of the lever 12, ensuring a rapid and good labelling operation. Thus, the breakage of the typing device 3 and noises attributable to the large stroke of the typing device can be avoided in the present invention.

Referring to FIGS. 12 to 17 showing an essential part of an example of the typing device incorporated in the hand labeller of the invention, rubber type wheels 45 are rotatably stretched between a roller 42 having protrusions 43 and a guiding member 44 spaced therefrom and fixed to the frame.

The type wheels carry on their peripheries a plurality of types projecting therefrom, of letters and symbols for typing. These types are correctly oriented when they assume a position on the guide member 44.

Figure 12:
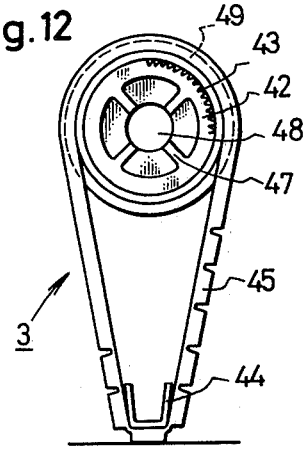
FIGS. 12 and 13 are side elevational view and a partially cut out perspective view of an essential part of a typing device incorporated in a hand labeller of the invention.
Figure 13:
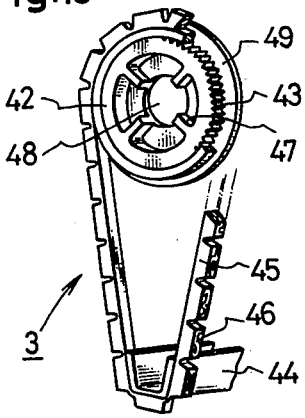
Figure 14:
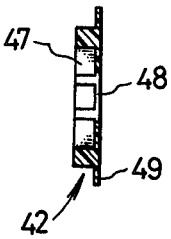
FIG. 14 is a sectional side elevational view of a roller of the typing device.

At the inside of the roller 42, there are provided a plurality of radial projections 47, as shown in FIGS. 12 to 14, and a bore 48 is formed at the center of the roller for passing a shaft therethrough.

A wall 49 is formed to project radially of the roller 42 at the flank of the later.

The wall 49 cooperates with the projections 47 in guiding the shaft 50, and acts to guide the type wheel 45.

Figure 15:
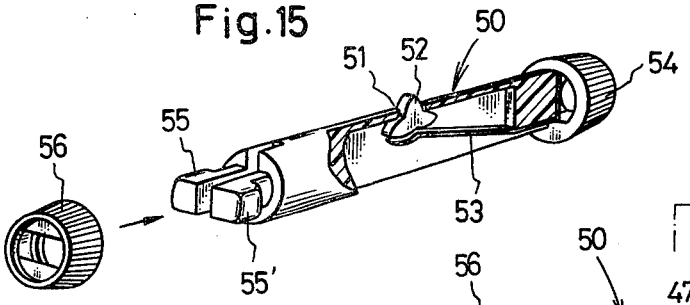
FIG. 15 is an exploded perspective view of a roller supporting shaft.

FIG. 15 is an exploded perspective view of the shaft 50 for supporting the roller 42. The shaft 51 has a central bore 51 through which projected is an engaging member 52 biased by a spring 53 disposed in a groove. The spring 53 is fixed at its end remote from the engaging member 52 by means of a cap 54 fixed to one end of the shaft. The other end of the shaft has engaging portions 55, 55' and is fitted by another cap member 56.

Figure 16:
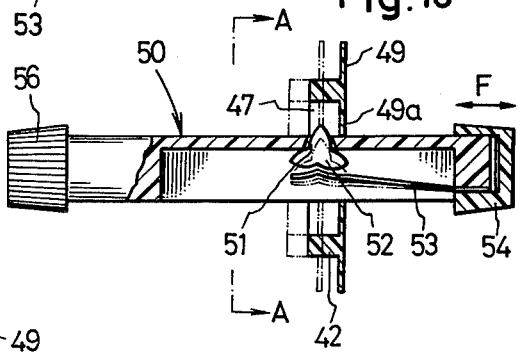
FIG. 16 is a front elevational view of the roller and the supporting shaft, showing the manner of mutual engagement thereof.
Figure 17:
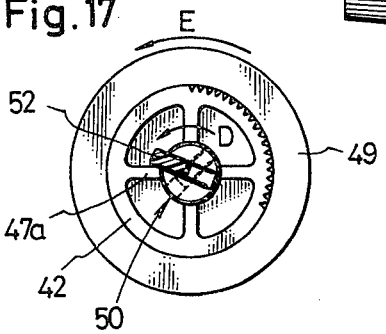
FIG. 17 is a sectional view taken along the line A—A of FIG. 16.

FIG. 16 is a sectional view of the shaft 50 carrying the roller 42, while the section taken along the line A—A is shown in FIG. 17.

The manner of operation of the typing device of the invention will be described hereinafter, with specific reference to FIGS. 16 and 17.

For rotating a selected type wheel 45, the engaging piece is positioned for engagement with the roller 42 carrying the selected type wheel. In this state, the engaging piece 52 carried by the shaft 50 is brought into engagement with the projection 47. As the shaft 50 is rotated in the direction of the arrow D, the engaging piece 52 comes to abut the projection 47a, so as to rotate the roller 42 in the direction of the arrow E. For rotating another type wheel, the shaft 50 is moved axially. When the roller 42 is brought to the position of the broken line, the engaging piece is depressed into the groove by the wall 49a, so as to allow the axial movement of the shaft 50 in the direction of the arrow F.

After positioning the engaging piece 52 for engaging the desired roller 42, through optional axial movement of the shaft 50, the engaging piece 52 then abuts the projection 47a to rotate the type wheel 45, as shown in FIG. 17, thereby to present the desired numeral or symbols on the supporting member 44.

The described construction of the typing device can be broadly applied to conventional typing devices having a plurality of rotatable elastic endless belts carrying types.

According to the typing device of this example, the shaft supporting the type wheels is allowed to move axially, while respective rollers carrying the type wheels are provided with projections 37 for engaging with engaging member 52 retractably provided on the shaft 50, so that the desired type wheel can be rotated by selectively bringing the engaging piece 52 into engagement with the projections 47, with a compact structure of the whole typing device.

Since the shaft 50 plays the double roles of supporting the type wheel rollers 42 and selecting the type wheel 45, the structure of the typing device is much simplified, because of the minimized number of parts.

In addition, since the engagement is performed between a retractable engaging piece 52 on the shaft 50 and radially disposed projections 47 on the roller 42, the engagement can be made without fail to ensure a rapid rotation of the wheel 45 to present the desired type.

At the same time, the engaging piece 52 biased outwardly by the spring 53 is swung and retracted into the shaft, as shown by broken line in FIG. 16, as the shaft 50 is axially moved. Since the swinging decreases the angle of inclination to the wall 49a of the roller, the axial movement of the shaft 50 is smoothened considerably.

Figure 18:
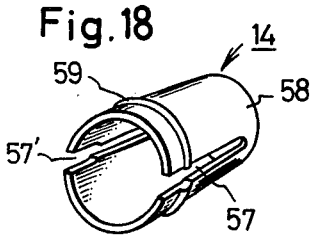
FIG. 18 is a perspective view of a supporting member for supporting a label sheet roll used in hand labeller of the invention.
Figure 19A:
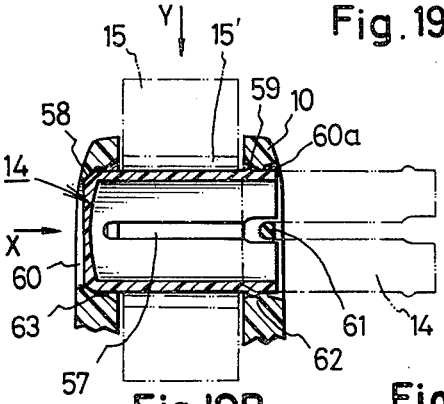
FIGS. 19A, 19B and 19C are a sectional view, a left-hand side elevational view and a right-hand side elevational view of a structure for supporting the label sheet roll.
Figure 19B:
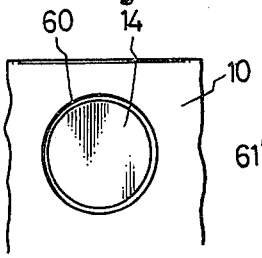
Figure 19C:
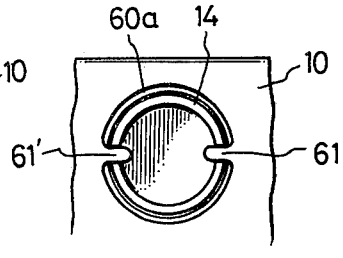
Figure 20:
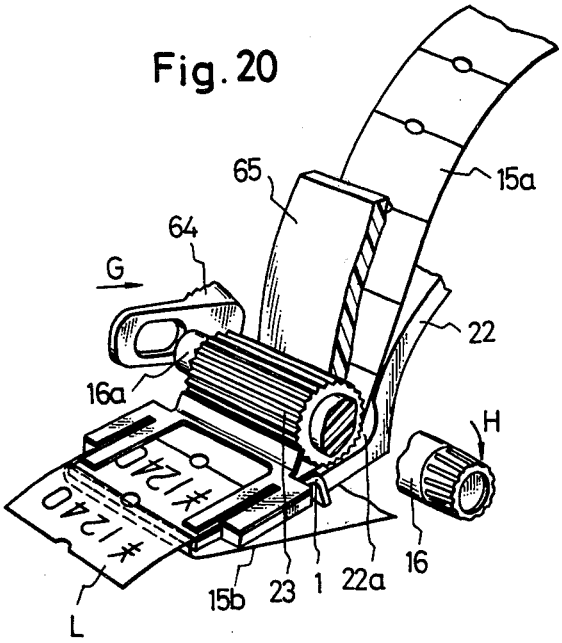
FIG. 20 is a perspective view showing a construction of a feeding roller and a guide plate incorporated in the hand labeller of the invention.

Referring now to FIGS. 18 and 19 showing an example of the label roll structure incorporated in the hand labeller of the invention, the label sheet roll 15 is detachably secured at an upper rear end portion of the labeller body 10, by means of a supporting member 14 as shown in FIG. 18.

As will be seen from FIG. 18, the supporting member 14 has a generally cylindrical form, having two slits 57, 57' at the flank. A flange-like annular projection or protrusion 59 is formed around the cylindrical body of the member 14, close to the end thereof opposite to the head 58.

The protrusion 59 constitutes a retaining portion.

As shown in FIG. 19A, the supporting member 14 is adapted to be received by a bore 60 formed in the labeller body 10, for a movement in the direction of the arrow X. For informations, the labeller body 10 is of a split type consisting of two halves, so that they may be assembled into the body 10 after placing the supporting member 14 at the right place between the two halves.

As will be seen from FIG. 19B, the one end of the bore 60 is rounded and has a reduced diameter from preventing the supporting member 14 from being dropped off, while the other end 60*a* is provided with two projections 61, 61' for engaging the ends of the slits 57, 57' of the member 14 so as to prevent the later 14 from being moved axially in the direction X out of the bore.

The bore end 60*a* is further provided with an annular protrusion 62 for engagement with the protrusion 59 when the supporting member 14 is moved to the position shown by the full line in FIG. 19A, thereby to locate the head 58 in contact with the tapered portion 63 of the labeller body 10. (The supporting member 14 itself can be resiliently deformed so as to allow the protrusion 59 to ride over the protrusion 62, when the member 14 is moved axially.)

In use, the supporting member 14 is moved as shown by a broken line of FIG. 19*a*, so that the label sheet roll 15 may be inserted into the labeller body 10 as denoted by the arrow Y. Then, the supporting member 14 is moved axially in the direction of the arrow X to bring the protrusion 59 inwardly of the protrusion 62, so that the supporting member 14 may be resiliently seated within the labeller body 10 at right position, thereby to secure the label sheet roll 15.

For detaching the core 15' of the roll 15 from the labeller, fingers are inserted through a bore 66 formed lower rear portion of the labeller body 10 to support the core 15'. A subsequent pushing of the supporting member 14 to the position of broken line in FIG. 19A allows the separation of the core 15' from the supporting member.

In this example, bores 60, 60*a* are formed in the rear portion of the labeller body 10, for receiving a supporting member 14 in such a manner that the member 14 may be extracted and retracted laterally of the labeller body 10. This construction facilitates the attaching and detaching of the label roll sheet 15, contributing greatly to simplify the structure for supporting the label sheet roll 15. In addition, the construction of this example well meets the pistol-shaped configuration of the hand labeller, presenting an attractive appearance.

Referring now to FIGS. 20 to 23 showing the detail of the construction of the feed roller section of the hand labeller in accordance with the invention, the feed roller 23 has at its peripheral surface a plurality of fine transverse grooves or knurls for ensuring the trapping of the label sheet 15. The shaft 16 which is shown also in FIG. 2 has a portion 16*a* for engagement with a pressing member 64. The portion 16*a* is received by an elongated bore formed in the labeller body 10, and is movable in the direction of the arrow G being pressed by the pressing member 64. The shaft 16 has the other end projecting through another elongated bore in the labeller body 10.

Finger retaining knurls are formed on the other end of the shaft 16, which facilitates the operation to rotate the shaft in the direction of the arrow H and to move it to and from a curved portion 22*a* of the guide plate 22.

Therefore, the label sheet 15*a* can be pressed onto the curved section 22*a*, by pinching the shaft ends 16, 16*a* to move the later as arrows G, G', thereby to correct the bending tendency of the label sheet. The rotation of the shaft 16 causes the feed of the label sheet.

Before the above stated operation is made, the back cover 17 of FIG. 5 has been opened to the position of the broken line 17'.

The label sheet 15*a* having been pressed by the feed roller 23 onto the curved section 22*a* of the guide plate 22 is then passed on the anvil plate 1. As it further passes the end of the anvil plate 1, the label sheet is acutely bent to separate the label L from the carrier paper. The carrier paper is then moved along its path 15*b*, while the label L separated from the carrier is slightly and temporarily adhered to the label receiving claw 24, preparing for labelling onto the object.

Figure 21:
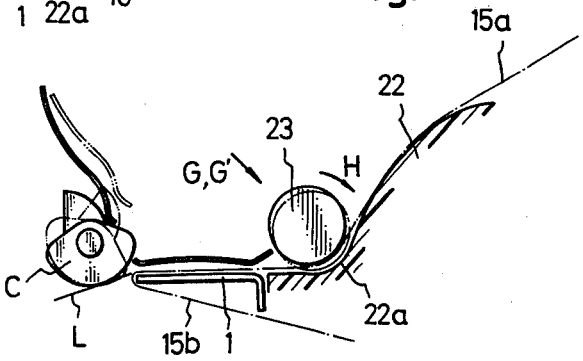
FIG. 21 is an illustration for explaining the manner of operation of the feed roller of FIG. 20.
Figure 22:
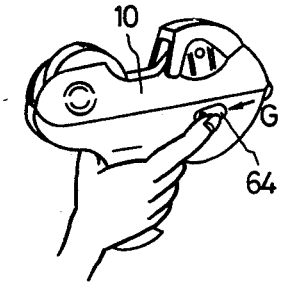
FIGS. 22 and 23 are illustrations for explaining the operation of the feed roller.

FIG. 21 shows the feed roller 23 pressing the label sheet 15*a* onto the guide plate 22, while FIG. 22 shows a pulling of the pressing member 64 by a right-hand finger in the direction of the arrow G.

Figure 23:
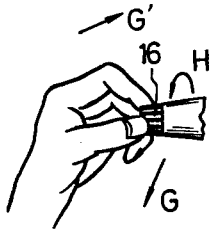

FIG. 23 illustrates an operation of the shaft 16 by left-hand fingers.

In this arranement for the feeding roller, a guiding plate 22 having a curved section is provided to extend between the surface of a sprocket 21 and the end of an anvil plate 1. A feed roller 23 is positioned confronting the curved section 22*a* of the guide plate. The feed roller 23 is carried by a shaft 16, 16*a* which can be operated from the outside of the labeller body 10, so that the label sheet 15*a* can be pressed onto the curved section by the feed roller for correcting undue bending of the sheet. At the same time, normal feed of the sheet can be performed by the feed roller 23.

A guide plate 65 is provided above the aforementioned guide plate 22. The arrangement is such that the label sheet 15*a* fed through an opening provided in the extension of the lever core 26 is suitably guided into the gap between the guide plates 22 and 65 to automatically reach the curved section 22*a*, so as to allow the further feed by the feed roller 23.

Turning to the conventional arrangement, it is necessary to one pull out the label sheet 15*a* out of the labeller, as shown by a chain line in FIG. 5, and then direct the leading end of the sheet along the anvil plate toward the lower surface of the labelling roller, because there are no provision of the guiding plate having a curved section and cooperating feed roller. This manual loading of the conventional labeller with the label sheet is extremely difficult, because the sheet which has been wound in a roll has a tendency to naturally curve, so as to direct its leading end toward the ink roller, especially for those who are not trained in the operation.

However, according to the invention, this troublesome work is completely dispensed with, presenting an easier loading of the labeller.

What is claimed is:

1. A hand labeller comprising a label sheet roll for supplying a label sheet having a label blank laminated on a carrier paper, a typing device for pressing said label sheet onto an anvil plate thereby to effect a typing on said label blank for each one of the successive label pieces, and labelling means for labelling the label carrying the typed information onto an object, wherein said labelling means include a labelling cam having a cut out or partially removed back, said labelling cam being allowed to swing reciprocatorily within such an angular range that said removed back does not interrupt the passage of an ink roller, wherein said label sheet roll is adapted to be supported by a supporting member passing through a bore formed therein between two walls of the labeller body, said supporting member having at least one slit extending from one axial end to an intermediate portion thereof toward the other axial end, and a retaining portion provided in the vicinity of the starting end of the slit, said retaining portion being for engaging a cooperating retaining portion formed on one wall of said labeller body to be located by the later, said slit being engaged by a projection formed in said wall of said labeller body thereby to prevent said supporting member from dropping from said labeller body.

2. A hand labeller as claimed in claim 1, wherein said labelling cam has a cam contour constituted by a curved surface having a radius larger than the distance between the center of a shaft or pin in support of said cam and the surface thereof.

3. A hand labeller as claimed in claim 1, wherein said back of said labelling cam is cut out to form a groove-like recess.

4. A hand labeller as claimed in claim 1, characterized by comprising a guide plate having an intermediate curved section, and a feed roller disposed around said curved section for pressing said label sheet onto said curved section of said guide plate.

5. A hand labeller as claimed in claim 1, wherein said typing device has type-wheel-supporting rollers each of which having projections directed toward the supporting shaft thereof, and an engaging piece disposed in a bore formed in said supporting shaft and resiliently biased to project out of said supporting shaft, said engaging piece being adapted to be brought into engagement with said projection as said supporting shaft is rotated.

6. A hand labeller as claimed in claim 5, wherein said rollers have a wall connecting one end of said projections, said wall being adapted to be abutted by said engaging piece when said supporting shaft is moved axially to depress said engaging piece, said engaging piece being adapted to be carried by said supporting shaft by the axial movement of the latter for engagement with said roller of any desired type wheel, to rotate the later.

7. A hand labeller comprising a label sheet roll for supplying a label sheet having a label blank laminated on a carrier paper, a typing device for pressing said label sheet onto an anvil plate thereby to effect a typing on said label blank for each one of the successive label pieces, and labelling means for labelling the label carrying the typed informations onto an object, wherein said label sheet roll is supported between two walls of a labeller body by means of a supporting member psssing through a central bore formed therein, said supporting member having at least one slit extending from one axial end to an intermediate length thereof toward the other axial end, and a retaining portion provided in the vicinity of the starting end of said slit, said retaining portion being adapted to engage a cooperating retaining portion formed in one wall of the labeller body to be located by the later, said slit engaging a projection formed in said wall thereby to prevent said supporting member from being axially dropped off from said labeller body.

8. A hand labeller as claimed in claim 7, wherein two slits are formed at both sides of the cylindrical body of said supporting member, diametrically opposing to each other.

9. A hand labeller comprising a label sheet roll for supplying a label sheet having a label blank laminated on a carrier paper, a typing device for pressing said label sheet onto an anvil plate thereby to effect a typing on said label blank for each one of the successive label pieces, labelling means for labelling the label carrying the typed information onto an object, wherein said labelling means include a labelling cam having a cut out or partially removed back, said labelling cam being allowed to swing reciprocatorily within such an angular range that said removed back does not interrupt the passage of an ink roller, a guide plate having an intermediate curved section, and a feed roller disposed around said curved section for pressing said label sheet onto said curved section of said guide plate.

10. A hand labeller as claimed in claim 9, wherein said labelling cam has a cam contour constituted by a curved surface having a radius larger than the distance between the center of a shaft or pin in support of said cam and the surface thereof.

11. A hand labeller as claimed in claim 9, wherein said back of said labelling cam is cut out to form a groove-like recess.

12. A hand labeller as claimed in claim 9, wherein said typing device has type-wheel-supporting rollers each of which having projections directed toward the supporting shaft thereof, and an engaging piece disposed in a bore formed in said supporting shaft and resiliently biased to project out of said supporting shaft, said engaging piece being adapted to be brought into engagement with said projection as said supporting shaft is rotated.

13. A hand labeller comprising a label sheet roll for supplying a label sheet having a label blank laminated on a carrier paper, said label sheet roll being adapted to be supported by a supporting member passing through a bore formed therein between two walls of the labeller body, said supporting member having at least one slit extending from one axial end to an intermediate portion thereof toward the other axial end, and a retaining portion provided in the vicinity of the starting end of the slit, said retaining portion being for engaging a cooperating retaining portion formed on one wall of said labeller body to be located by the latter, said slit being engaged by a projection formed in said wall of said labeller body thereby to prevent said supporting member from dropping from said labeller body, a typing device for pressing said label sheet onto an anvil plate thereby to effect a typing on said label blank for each one of the successive label pieces, and labelling means for labelling the label carrying the typed information onto an object, wherein said typing device has type-wheel-supporting rollers having a plurality of projections extending toward the supporting shaft thereof, and an engaging piece disposed in a bore formed in said supporting shaft and resiliently biased to project out of said supporting shaft, said engaging member being adapted to be brought into engagement with said projections by a rotation of said supporting shaft.

14. A hand labeller as claimed in claim 13, wherein said rollers have a wall connecting one end of said projections, said wall being adapted to be abutted by said engaging piece when said supporting shaft is moved axially to depress said engaging piece, said engaging piece being adapted to be carried by said supporting shaft by the axial movement of the later for engagement with said roller of any desired type wheel, to rotate the later.

15. A hand labeller comprising a label sheet roll for supplying a label sheet having a label blank laminated on a carrier paper, a guide plate having an intermediate curved section, a feed roller disposed around said curved section for pressing said label sheet onto said curved section of said guide plate, a typing device for pressing said label sheet onto an anvil plate thereby to effect a typing on said label blank for each one of the successive label pieces, and labelling means for labelling the label carrying the typed information onto an object, wherein said typing device has type-wheel-supporting rollers having a plurality of projections extending toward the supporting shaft thereof, and an engaging piece disposed in a bore formed in said supporting shaft and resiliently biased to project out of said supporting shaft, said engaging member being adapted to be brought into enagement with said projections by a rotation of said supporting shaft.

16. A hand labeller as claimed in claim 15, wherein said rollers have a wall connecting one end of said projections, said wall being adapted to be abutted by said engaging piece when said supporting shaft is moved axially to depress said engaging piece, said engaging piece being adapted to be carried by said supporting shaft by the axial movement of the later for engagement with said rollers of any desired type wheel, to rotate the later.

* * * * *